US007527424B2

(12) United States Patent
Lechot et al.

(10) Patent No.: US 7,527,424 B2
(45) Date of Patent: May 5, 2009

(54) ANTI-TRIP DEVICE FOR TIMEPIECE ESCAPEMENT

(75) Inventors: Dominique Lechot, L'Orient (CH); Alain Zaugg, Le Brassus (CH); Thierry Conus, Lengnau (CH); Andrés Cabezas Jurin, Yverdon-les-Bains (CH)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 11/610,961

(22) Filed: Dec. 14, 2006

(65) Prior Publication Data

US 2007/0140066 A1 Jun. 21, 2007

(30) Foreign Application Priority Data

Dec. 20, 2005 (EP) ..... 05112521

(51) Int. Cl.
*G04B 15/00* (2006.01)
*G04B 17/00* (2006.01)

(52) U.S. Cl. ..... 368/127; 368/169

(58) Field of Classification Search ..... 368/127, 368/128–133
See application file for complete search history.

(56) References Cited

U.S. PATENT DOCUMENTS 710,823 A * 10/1902 Voigt ..... 368/132
867,015 A * 9/1907 Coullery ..... 368/127
2,591,876 A * 4/1952 Fritz-Andre ..... 368/125
3,041,819 A 7/1962 Ensign et al.

FOREIGN PATENT DOCUMENTS

| | | |
|---|---|---|
| CH | 28540 | 7/1903 |
| EP | 1 143 307 A1 | 10/2001 |
| EP | 1 538 491 A1 | 6/2005 |

OTHER PUBLICATIONS

Irk, Alois, "Der Chronometergang," Deutsche Uhrmacher Zeitung, Berlin 1923.

European Search Report issued in corresponding application No. EP 05 11 2521, completed Oct. 27, 2006.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

The anti-trip device for a timepiece escapement essentially includes a sprung balance (1), this device preventing the angular extension of said balance beyond a normal angle of rotation. The device is characterized in that the arbour (2) fitted to the balance (1) is provided with a pinion (3) meshing with means (4) preventing said balance from rotating beyond said normal angle of rotation, whatever the direction of said rotation.

7 Claims, 2 Drawing Sheets

ANTI-TRIP DEVICE FOR TIMEPIECE ESCAPEMENT

This application claims priority from European Patent Application No. 05112521.9 filed 20 Dec. 2005, the entire disclosure of which is incorporated herein by reference.

FIELD OF THE INVENTION

The present invention relates to an anti-trip device for a timepiece escapement, essentially including a sprung balance, this device preventing the angular extension of said balance beyond a normal angle of rotation.

BACKGROUND OF THE INVENTION

Several anti-trip device systems can be found in patent literature. One of these was described in the work entitled, "Der Chronometer Gang" by Professor Alois Irk and published by Deutsche Uhrmacher Zeitung, Berlin 1923. Reference can be made in particular to paragraphs 116 to 120 (pages 74 to 77) and to FIG. 25 of the aforecited work. This device is implemented in an escapement comprising amongst other things a balance spring formed of several coils and a balance provided with at least one arm, the balance being pivotably mounted between a plate and a bridge. The device comprises a finger fixed on the balance arm, two columns between which the finger can pass when the balance is in movement, these columns being secured to the balance bridge, and a locking arm fixed to the external coil of the balance spring. The locking arm is able to be inserted between the columns and the finger to prevent the balance from rotating beyond an angle exceeding its normal operating angle.

This device is implemented in so-called detent escapements which are suited to timepieces of large dimensions such as marine chronometers. These timepieces are appreciated for their high level of precision, which is why a detent escapement, which is itself known for its high precision, is often used. This escapement has, however, a significant defect, namely its sensitivity to shocks. Consequently, it is known to be unsuitable for wristwatches. Indeed, a shock applied to the timepiece can cause its balance to rotate beyond a normal operating angle. This then produces a trip, at least for one direction of rotation of the balance, since two unlockings and two pulses occur during the same vibration.

When one wishes to fit a timepiece of small dimensions, for example a wristwatch, with a detent escapement in order to replace, for example, a conventional Swiss lever escapement, and thus enable the timepiece to enjoy the advantages conferred by this escapement, new techniques, different from those known to date will have to be used if one wishes to avoid failure. Various solutions have been proposed recently for compensating for the lack of energy developed by the sprung balance of a wristwatch to overcome the forces acting on the detent of a detent escapement. One solution is explained, for example, in EP Patent No. A 1 538 491. Nonetheless the problem of tripping remains and this has to be solved when a balance spring of small dimensions, such as that mounted in a wristwatch, is involved.

The solution proposed by Alois Irk described hereinbefore could be applied to a wristwatch but seems to have straight away at least two drawbacks. The first drawback appears to be the use of a locking element fixed to a resilient element, in this case the external coil of the balance spring. This is not a very mechanical solution, subject to all kinds of unanticipated unknowns linked to the resilience of the balance spring, which might deform in an unexpected manner, and precisely following a shock applied to the watch. The second drawback lies in the fact that the Irk system only operates in one rotational direction of the balance, the direction of the largest expansion of the balance spring. In the other direction, the direction of contraction of the balance spring, the escapement can also trip and the Irk system thus remains inefficient.

SUMMARY OF THE INVENTION

In order to overcome the aforecited drawbacks, the present invention, in addition to answering the generic definition stated in the first paragraph of this description, is characterized in that the arbour which is fitted to the balance is provided with a pinion meshing with means preventing said balance from rotating beyond a normal angle of rotation, whatever the direction of rotation.

BRIEF DESCRIPTION OF THE DRAWINGS

The features and advantages of the present invention will appear more clearly from the following description, made with reference to the annexed drawings, and providing two advantageous embodiments by way of non limiting explanatory example. In the drawings.

DETAILED DESCRIPTION OF THE ILLUSTRATIVE EMBODIMENTS

Figure 1:
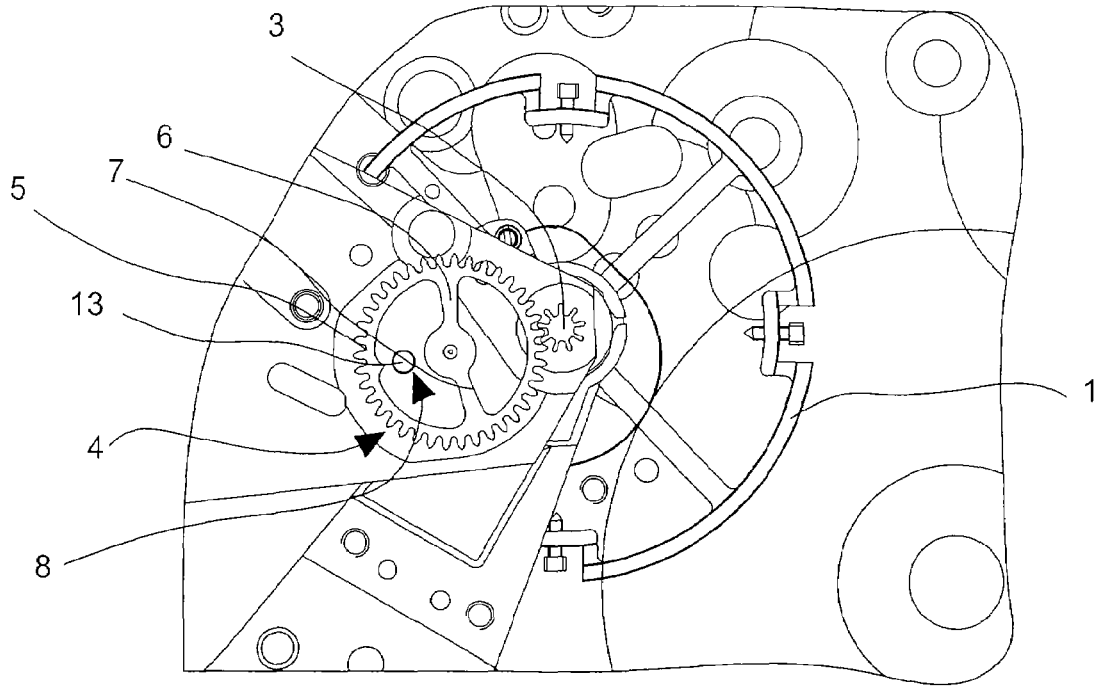
FIG. 1 is a plan view of the anti-trip device according to a first embodiment.

The annexed Figures show two embodiments of the anti-trip device according to the invention. This device is for a timepiece escapement, more particularly, but not exclusively, for a detent escapement of which only those elements necessary for comprehension of the invention are shown in the Figures, namely essentially a sprung balance 1 including a balance spring 100 fixedly attached to the balance 1 by one end and balance cock 16 by its other end such that the sprung balance is pivoted between plate 15 and balance cock 16. The balance 1 is able to oscillate via an arbor 2 and extends around the arbour 2. The anti-trip device is for preventing the angular extension of the balance 1 beyond a normal operating or rotational angle.

The detent escapement is taken here as an example to which the anti-trip device could apply. This escapement further includes the following elements, which are not shown in the drawings, but are clear in the aforecited Patent No. EP-A 1 538 491, namely: an escapement wheel provided with generally pointed teeth which rest in turn on a locking pallet stone, a brake lever, this brake lever carrying at its first end said locking pallet stone and at its second end a first activating finger able to be activated by a second activating finger carried by a plate secured to the balance, this plate further carrying an impulse pallet stone able to receives impulses from the teeth of the escape wheel. At each oscillation of the balance, the locking pallet stone is released from the tooth of the escape wheel and another tooth of the same wheel, acting on the impulse pallet stone, imparts an impulse to the balance. It will be observed that the second activating finger is arranged so as only to activate the first finger of the brake lever in one direction of rotation of the balance, i.e. during the first vibration of the oscillation after which the impulse occurs. When the balance rotates in the other direction, i.e. during the second vibration of the oscillation, the first finger of the brake lever is not activated since the second finger carried by the plate is arranged to retract, after which no impulse is generated.

It is clear from the explanations that have just been given that if the first vibration causes the balance to rotate beyond a normal amplitude which is of the order of 320 degrees, for example after a shock applied to the watch, the first finger of the brake lever can be activated a second time. A second impulse is thus generated during the same vibration, which causes the escapement to trip. It will easily be understood that if the second vibration causes the balance to rotate beyond its normal operating amplitude, the second finger carried by the plate can retract a second time after which, by changing the direction of rotation of the plate, said second finger causes the locking pallet stone to be released, then an undesired impulse, thus falsifying the isochronism of the balance.

In order to prevent the angular extension of the balance and thus avoid the drawbacks cited in the above paragraph, the present invention is characterized in that, as shown in all the annexed Figures, arbour 2 fitted to balance 1 is provided with a pinion 3 meshing with means 4 preventing said balance 1 from rotating beyond a normal angle of rotation, whatever the direction of such rotation.

Figure 2:
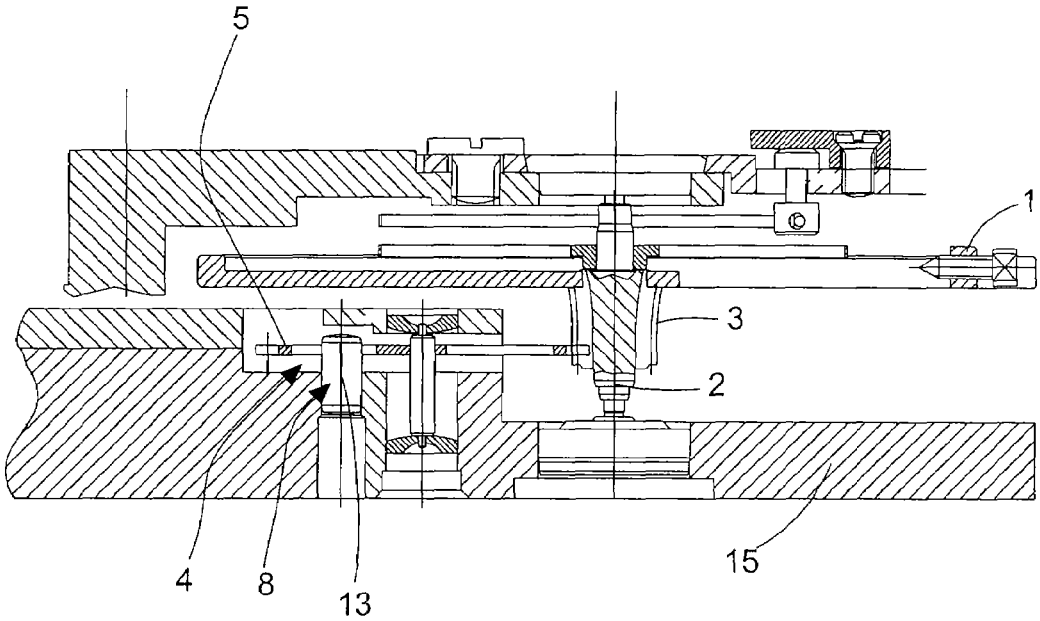
FIG. 2 is a cross-section of the embodiment shown in FIG. 1.

FIGS. 1 and 2 show a first embodiment of the invention. Here, means 4 prevent balance 1 from rotating beyond a normal angle of rotation consisting of one toothed wheel 5 meshing with pinion 3 carried by arbour 2 of balance 1. This wheel 5 carries at least two spokes 6 and 7 able to abut against a fixed stop member 8 if balance 1 is being driven beyond its normal angle of rotation. FIG. 2 shows more precisely that fixed stop member 8 is a pin 13 driven into plate 15 comprised in the timepiece.

Figure 3:
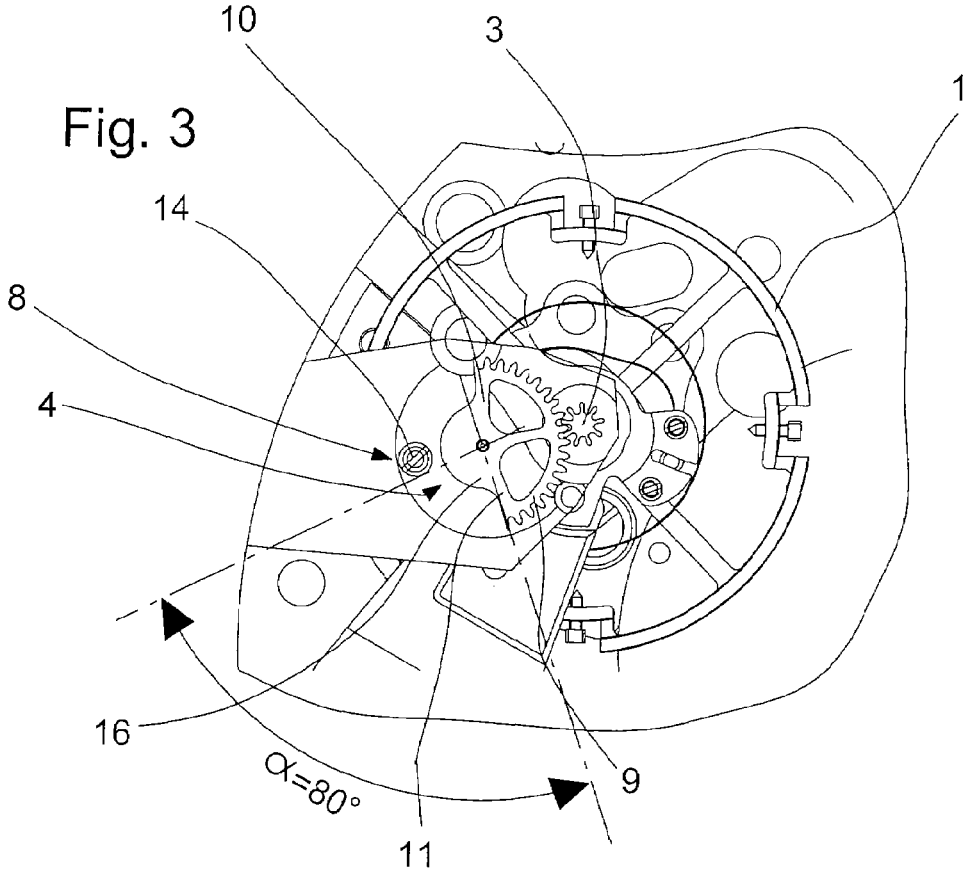
FIG. 3 is a plan view of the anti-trip device according to a second embodiment.
Figure 4:
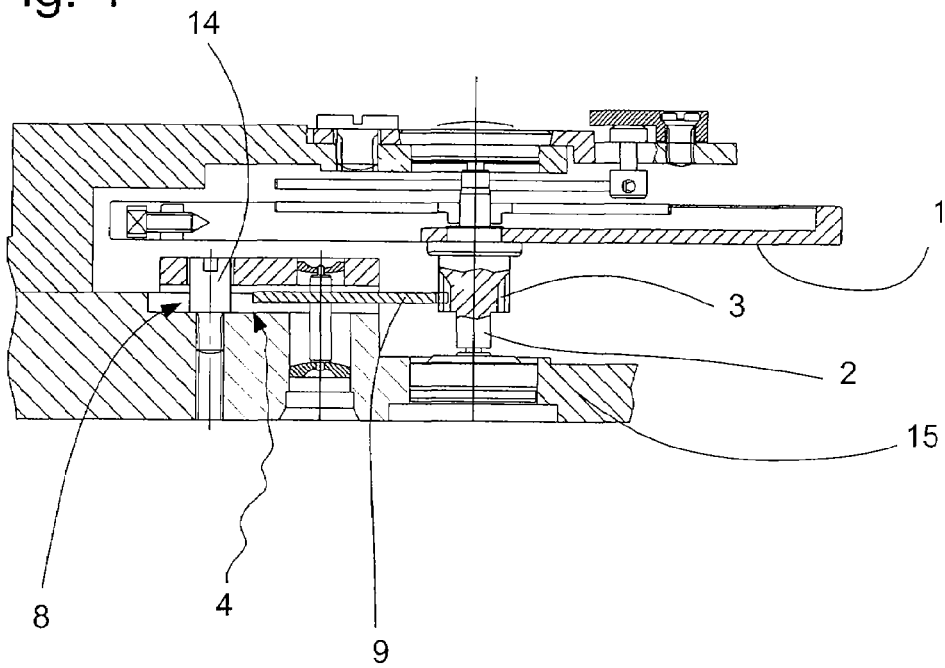
FIG. 4 is a cross-section of the embodiment shown in FIG. 3.

FIGS. 3 and 4 show a second embodiment of the invention. Here, means 4 prevent balance 1 from rotating beyond a normal angle of rotation consisting of one pivoting toothed sector formed of a rack 9. This rack 9 carries two end spokes 10 and 11 able to abut against a fixed stop member 8 if the balance is being driven beyond its normal angle of rotation. FIG. 4 shows more precisely that fixed stop member 8 is a pin 14 screwed into plate 15 comprised in the timepiece.

It can be seen that for both embodiments, spokes 6 and 7 of wheel 5 and end spokes 10 and 11 of rack 9 prevent balance 1 from rotating beyond its normal operating angle, whatever its direction of rotation, which is an advantage in relation to the system proposed above by Alois Irk where this limitation only occurs in one direction of rotation of the balance. It will also be observed that the present invention relies upon a mechanical connection which could be called rigid between the balance and the means limiting its travel since it uses a gear connection without any resilient elements as proposed by Alois Irk.

The two embodiments taken by example show that pinion 3 of balance 1 comprises nine wings. Wheel 5 of FIG. 1 and rack 9 of FIG. 3 (if added to a complete wheel) each include thirty-eight teeth hence a gear ratio of 9/38=0.24. It was indicated hereinbefore that the normal amplitude of the balance is of the order of 320 degrees, which means that rack 9 of FIG. 3 rotates at an angle of 320×0.24=76.8 degrees. As FIG. 3 shows, limiting the rotation of the rack to an angle $\propto$=80°, on the one hand ensures that the escapement works properly, and on the other hand prevents any tendency to trip. This limitation occurs when end spoke 11 abuts against pin 14. The same is true for the other direction of rotation of the balance where the end spoke 10 meets pin 14 and for which the same angle of 80° is found, but which is not shown in the drawing.

As wheel 5, or rack 9, is permanently meshed with pinion 3 of the balance that moves incessantly, it is important to choose for such elements materials that have a very low friction coefficient. Experience has shown good results if pinion 3 is made of steel and if wheel 5, or rack 9, is made of brass.

Of the two embodiments that have just been described, a slight preference is given to that implementing rack 9. This element is lighter than a whole wheel. The problem of balancing rack 9 however arises. FIG. 3 shows that a counterweight 16 is used, opposite to the toothing of the rack and placed as close as possible to the centre of rotation in order to lower the moment of inertia of the entire assembly.

According to a variant that is not shown, toothed wheel 5 may carry only one spoke, in such case, the gear ratio between this wheel and pinion 3 would be adapted such that the arm abuts against fixed stop member 8 if the balance is driven beyond the normal angle.

The invention claimed is:

1. An anti-trip device associated with a timepiece escapement of a timepiece, wherein the timepiece escapement includes:

(a) a balance disposed to oscillate on a support via an arbour;

(b) a balance spring fixedly attached to the balance and to the support, wherein the anti-trip device is disposed to prevent angular extension of the balance beyond a normal angle of rotation, wherein the balance spring extends around the arbour, and wherein the arbour fitted to the balance is provided with a pinion meshing with the anti-trip device, wherein the anti-trip device includes means for preventing the balance from rotating beyond the normal angle of rotation whatever the direction of the rotation;

(c) an escapement wheel provided with teeth; and (d) a pallet carrying locking pallet-stones, wherein said teeth rest in turn on the locking pallet-stones, wherein the means for preventing the balance from rotating beyond the normal angle of rotation comprises a multi-toothed wheel or a multi-toothed sector independent from the pallet, wherein the multi-toothed wheel or multi-toothed sector is pivoted in a fixed plate disposed in the timepiece.

2. The anti-trip device associated with a timepiece escapement of a timepiece according to claim 1, wherein the anti-trip device further comprises a fixed stop member, and wherein said means for preventing the balance from rotating beyond the normal angle of rotation comprises the multi-toothed wheel, wherein the multi-toothed wheel comprises at least one spoke able to abut against the fixed stop member when the balance is driven beyond said normal angle of rotation.

3. The anti-trip device associated with a timepiece escapement of a timepiece according to claim 2, wherein said fixed stop member is a pin fixed in the plate comprised in the timepiece.

4. The anti-trip device associated with a timepiece escapement of a timepiece according to claim 1, wherein the anti-trip device further comprises a fixed stop member, and wherein said means for preventing the balance from rotating beyond the normal angle of rotation comprises said multi-toothed sector, wherein said multi-toothed sector pivots and forms a rack, and wherein said multi-toothed sector further comprises two end spokes able to abut against the fixed stop member when the balance is driven beyond said normal angle of rotation.

5. The anti-trip device associated with a timepiece escapement of a timepiece according to claim 4, wherein said fixed stop member is a pin fixed in the plate comprised in the timepiece.

6. The anti-trip device associated with a timepiece escapement of a timepiece according to claim 1, wherein the gear ratio between the pinion and said means for preventing the balance from rotating beyond the normal angle of rotation driven by said pinion is of the order of 0.24.

7. An anti-trip device associated with a timepiece escapement of a timepiece, wherein the timepiece escapement includes:

(a) a balance disposed to oscillate on a support via an arbour;

(b) a balance spring fixedly attached to the balance and to the support, wherein the anti-trip device is disposed to prevent angular extension of the balance beyond a normal angle of rotation, wherein the balance spring extends around the arbour, and wherein the arbour fitted to the balance is provided with a pinion meshing with the anti-trip device, wherein the anti-trip device includes means for preventing the balance from rotating beyond the normal angle of rotation whatever the direction of the rotation;

(c) an escapement wheel provided with teeth; and (d) locking pallet-stones, wherein said teeth rest in turn on the locking pallet-stones, wherein the means for preventing the balance from rotating beyond the normal angle of rotation comprises a multi-toothed wheel or a multi-toothed sector independent from the locking pallet-stones, wherein the multi-toothed wheel or multi-toothed sector is pivoted in a fixed plate disposed in the timepiece.

* * * * *